US010214270B1

(12) United States Patent
Berche et al.

(10) Patent No.: US 10,214,270 B1
(45) Date of Patent: Feb. 26, 2019

(54) PERSONAL WATERCRAFT

(71) Applicant: BOMBARDIER RECREATIONAL PRODUCTS INC., Valcourt (CA)

(72) Inventors: Charles-Edouard Berche, Granby (CA); Guillaume Longpre, Valcourt (CA); Nicolas Roy, Richelieu (CA); Maxime Valence, Saint-Cesaire (CA); Kim Ross, Valcourt (CA)

(73) Assignee: BOMBARDIER RECREATIONAL PRODUCTS INC., Valcourt (CA)

( * ) Notice: Subject to any disclaimer, the term of this patent is extended or adjusted under 35 U.S.C. 154(b) by 0 days.

(21) Appl. No.: 15/583,192

(22) Filed: May 1, 2017

Related U.S. Application Data

(60) Provisional application No. 62/329,549, filed on Apr. 29, 2016.

(51) Int. Cl.

| | |
|---|---|
| ***B63B 35/73*** | (2006.01) |
| ***B63H 11/04*** | (2006.01) |
| ***B63B 29/04*** | (2006.01) |
| ***B63B 3/48*** | (2006.01) |

(52) U.S. Cl.
CPC ..... *B63H 11/04* (2013.01); *B63B 3/48* (2013.01); *B63B 29/04* (2013.01); *B63B 35/731* (2013.01); *B63B 2029/043* (2013.01); *B63B 2751/00* (2013.01)

(58) Field of Classification Search
CPC ..... B63H 11/00; B63H 11/04; B63H 11/08; B63H 2011/00; B63H 2011/02; B63H 2011/04; B63H 2011/08; B63H 2011/081; B63B 35/73; B63B 35/731; B63B 2035/73; B63B 2035/737; B63B 29/04; B63B 2029/043; B63B 3/48; B63B 2003/48; B63B 2003/485; B63B 2751/00
USPC ..... 440/38; 114/55.5, 55.53, 55.55, 55.57, 114/343, 363, 364, 88, 362
See application file for complete search history.

(56) References Cited

U.S. PATENT DOCUMENTS

| | | | | |
|---|---|---|---|---|
| 5,490,474 | A * | 2/1996 | Ikeda | B63B 35/731 114/343 |
| 5,570,654 | A | 11/1996 | Rood | |
| 5,752,867 | A * | 5/1998 | Koyanagi | B63B 29/04 114/363 |
| 5,915,329 | A | 6/1999 | Watkins et al. | |
| 5,964,172 | A | 10/1999 | Ikeda | |
| 6,041,732 | A | 3/2000 | Ikeda | |

(Continued)

FOREIGN PATENT DOCUMENTS

WO 2010147518 A1 12/2010

*Primary Examiner* — Daniel V Venne
(74) *Attorney, Agent, or Firm* — BCF LLP

(57) ABSTRACT

A personal watercraft has a hull having a bow and a stern. A deck is disposed on the hull and has a rear platform having a top face. The top face defines at least a portion of a generally planar surface. The generally planar surface extends forward from a rear end of the deck. The personal watercraft also has a seat supported on the deck. The seat has a front seat portion and a rear seat portion. The rear seat portion is rearward of the front seat portion. The rear seat portion is removably connected to the deck. The rear platform extends between the rear end of the deck and the front seat portion. The generally planar surface extends to at least the front seat portion, and the rear seat portion is disposed on the top face of the rear platform when connected to the deck.

19 Claims, 11 Drawing Sheets

(56) References Cited

U.S. PATENT DOCUMENTS

| | | | | |
|---|---|---|---|---|
| 6,145,458 | A | 11/2000 | Hattori | |
| 6,874,438 | B2 * | 4/2005 | Nakajima | B63B 3/54 114/363 |
| 6,918,348 | B2 | 7/2005 | Matsuda et al. | |
| 7,124,703 | B2 | 10/2006 | Simard et al. | |
| 7,467,594 | B1 * | 12/2008 | Duquette | B63B 29/04 114/363 |
| 7,571,692 | B2 | 8/2009 | Kreger | |
| 8,037,835 | B2 | 10/2011 | Miura et al. | |
| 8,146,524 | B1 | 4/2012 | Cote et al. | |
| 8,261,683 | B2 | 9/2012 | Knoblett et al. | |
| 8,474,389 | B2 | 7/2013 | Otsuka et al. | |
| 8,555,799 | B2 | 10/2013 | Otsuka et al. | |
| 9,517,824 | B1 * | 12/2016 | Rondeau | B63H 20/06 |
| 2002/0073910 | A1 * | 6/2002 | Yamada | B63B 29/04 114/363 |
| 2002/0151231 | A1 * | 10/2002 | Nakase | B63B 35/731 440/89 H |
| 2003/0123419 | A1 * | 7/2003 | Rangnekar | H04L 45/02 370/338 |
| 2003/0140833 | A1 * | 7/2003 | Matsuda | B63B 29/04 114/55.57 |
| 2011/0253028 | A1 | 10/2011 | Falkman | |
| 2012/0180715 | A1 * | 7/2012 | Otsuka | B63B 29/04 114/363 |

* cited by examiner

PERSONAL WATERCRAFT

CROSS-REFERENCE TO RELATED APPLICATION

The present application claims priority to U.S. Provisional Patent Application Ser. No. 62/329,549, filed Apr. 29, 2016, entitled "Personal watercraft", which is incorporated by reference herein in its entirety.

FIELD OF THE TECHNOLOGY

The present technology relates to personal watercrafts.

BACKGROUND

Personal watercrafts have become very popular in recent years for recreational use. There also has been an increasing use of personal watercrafts in search and rescue operations and for transportation in coastal communities.

The seat of a conventional two- or three-seat personal watercraft is disposed on a pedestal formed by the deck of the personal watercraft. On a typical personal watercraft, the pedestal extends upwards from a reboarding platform positioned behind it, and upwards from the left and right footwells. It is known in the art to divide the seat in portions which can be removed separately or rearranged. For instance, in U.S. Pat. No. 8,261,683 B2 issued on Sep. 11, 2012, there is described a personal watercraft having two interchangeable rear seat portions: components 40, 41 which provide a second passenger seat and components 30, 31 which make it a two-seater vessel. Other known seat configurations are disclosed in U.S. Pat. No. 8,474,389 B2, U.S. Pat. No. 8,146,524 B1 and U.S. Pat. No. 7,571,692 B2 among other references.

The reboarding platform typically extends across the rear of the vessel, above the transom, and is bordered at its front by the pedestal and the left and right footwells. However, the reboarding platform is typically only large enough to enable a user to climb out of the water and onto the vessel. Some personal watercrafts have large rear platforms such as personal watercraft adapted for search and rescue operations. For instance, in the personal watercraft described in US 2011/0253028 A1 published on Oct. 20, 2011, the extended rear platform may provide room for rescuers or passengers.

It would be desirable to have a personal watercraft that provides the convenience of multiple seats while also providing the advantages of the extended rear platform.

Therefore, there is a desire for a personal watercraft having multiple seats and an extended rear platform, but which does not significantly increase the size of the personal watercraft compared to existing personal watercraft having multiple seats.

SUMMARY

It is an object of the present technology to ameliorate at least some of the inconveniences present in the prior art.

According to one aspect of the present technology, there is provided a personal watercraft including a hull having a bow and a stern. The personal watercraft has a deck disposed on the hull, the deck including a rear platform having a top face. The top face defines at least a portion of a generally planar surface, the generally planar surface extending forward from a rear end of the deck. The personal watercraft has a seat supported on the deck. The seat includes a front seat portion and a rear seat portion, the rear seat portion being rearward of the front seat portion. The rear seat portion is removably connected to the deck. The rear platform extends between the rear end of the deck and the front seat portion. The generally planar surface extends to at least the front seat portion. The rear seat portion is disposed on the top face of the rear platform when connected to the deck.

In some implementations, the deck further has a reboarding platform extending forward from the rear end of the deck, the reboarding platform defining a portion of the generally planar surface, and the rear platform extends forward of the reboarding platform.

In some implementations, the rear platform has a deck panel. The deck panel defines a portion of the generally planar surface, and the deck panel extends between the reboarding platform and the front seat portion.

In some implementations, the deck panel has a top face and the rear seat portion has a rear base. The rear base is removably connected to the top face of the deck panel.

In some implementations, one of the top face of the deck panel and the rear base has at least one peg. Another one of the top face of the deck panel and the rear base has at least one latch, and the at least one latch is configured to connect to the at least one peg.

In some implementations, the top face of the deck panel defines at least one recessed area. Each recessed area includes one of the at least one peg and the at least one latch.

In some implementations, the deck panel is removably connected to the deck.

In some implementations, the deck panel has a bottom face. The personal watercraft further has a gasket connected to the bottom face of the deck panel. The deck defines an aperture, and the deck panel covers at least partially the aperture when the deck panel is connected to the deck.

In some implementations, the personal watercraft further has padding material connected to the top face of the rear platform.

In some implementations, the top face of the rear platform defines at least one anchor.

In some implementations, the top face of the rear platform defines a handhold.

In some implementations, the front seat portion is removably connected to the deck.

In some implementations, the front seat portion has a front base having a bottom face. The personal watercraft further has a gasket connected to the bottom face of the front base. The deck defines an aperture, and the front base covers at least partially the aperture when the front seat portion is connected to the deck.

In some implementations, the front seat portion has concave portions defining knee rests for receiving knees of a rider of the personal watercraft sitting on the rear seat portion.

In some implementations, the front seat portion defines a back rest for a rider of the personal watercraft sitting on the front seat portion.

In some implementations, the front seat portion has a rear surface, and the rear surface is inclined such that an upper portion of the rear surface is positioned forward relative to a lower portion of the rear surface.

In some implementations, the rear surface overlaps the deck panel.

In some implementations, the rear seat portion has a front surface, and the front surface is inclined such that an upper portion of the front surface is positioned forward relative to a lower portion of the front surface.

In some implementations, the front surface of the rear seat portion is adjacent the rear surface of the front seat portion when the rear seat portion is connected to the deck.

In some implementations, the rear surface has a central portion for receiving a head of a rider lying down on the rear platform.

In some implementations, the rear seat portion has a rear base, and the personal watercraft further has at least one grab handle connected to the rear base.

In some implementations, the rear base and the at least one grab handle are removable from the deck together.

In some implementations, the rear seat portion has a cushion disposed on top of the rear base, and a majority of lateral sides of the rear base are exposed.

In some implementations, the at least one grab handle extends from the rear base at a position below a lower edge of the cushion.

In some implementations, the at least one grab handle includes a left grab handle and a right grab handle. The left grab handle extends from a left side of the rear base, and the right grab handle extends from a right side of the rear base.

In some implementations, for each of the left and right grab handles, the grab handle includes a handle portion, a front connecting arm connecting a front of the handle portion to the rear base, and a rear connecting arm connecting a rear of the handle portion to the rear base. The rear connecting arm is disposed upward and rearward relative to the front connecting arm.

In some implementations, the personal watercraft further has a left latch connected to a bottom left side of the rear base, and a right latch connected to a bottom right side of the rear base. The front connecting arm of the left grab handle is disposed forward of the left latch. The rear connecting arm of the left grab handle is disposed rearward of the left latch. The front connecting arm of the right grab handle is disposed forward of the right latch, and the rear connecting arm of the right grab handle is disposed rearward of the right latch.

In some implementations, the front seat portion has a front base and the rear seat portion has a rear base. The rear base has at least one tongue extending from a front face of the rear base. The front base defines at least one recess in a rear face of the front base, and the at least one tongue of the rear base is configured to be received in the at least one recess of the front base.

In some implementations, the personal watercraft further has a left seat connector removably connecting the rear seat portion to the deck on a left side of a longitudinal centerline of the personal watercraft, and a right seat connector removably connecting the rear seat portion to the deck on a right side of the longitudinal centerline.

In some implementations, each of the left and right seat connector includes a peg connected to one of the deck and the rear seat portion, and a latch connected to another one of the deck and the rear seat portion.

In some implementations, the pegs of the left and right seat connectors are connected to the deck, and the latches of the left and right seat connectors are connected to the rear seat portion.

In some implementations, the personal watercraft further has a propulsion system connected to at least one of the hull and the deck. The propulsion system includes a motor and a jet pump operatively connected to the motor. An intake ramp extends from an inlet to the jet pump, the inlet being defined at least in part by the hull on a bottom of the hull. The rear platform extends forward past the inlet of the intake ramp.

In some implementations, the generally planar surface extends upward and forward from the rear end of the deck.

In some implementations, the generally planar surface extends at an angle of less than 30 degrees from a waterline of the personal watercraft.

In some implementations, the angle is less than 15 degrees.

For purposes of this application, terms related to spatial orientation such as forwardly, rearward, upwardly, downwardly, left, and right, are as they would normally be understood by an operator of the vehicle sitting thereon in a normal riding position. Terms related to spatial orientation when describing or referring to components or sub-assemblies of the vehicle, separately from the vehicle, such as a deck or hull for example, should be understood as they would be understood when these components or sub-assemblies are mounted to the vehicle, unless specified otherwise in this application. The term "straddle-type seat" refers to a seat on which a person normally sits astride. The term "motor" can refer to any component capable of driving the motion of a watercraft, which includes but is not limited to an internal combustion engine or an electric motor.

Implementations of the present technology each have at least one of the above-mentioned object and/or aspects, but do not necessarily have all of them. It should be understood that some aspects of the present technology that have resulted from attempting to attain the above-mentioned object may not satisfy this object and/or may satisfy other objects not specifically recited herein.

Additional and/or alternative features, aspects and advantages of implementations of the present technology will become apparent from the following description, the accompanying drawings and the appended claims.

BRIEF DESCRIPTION OF THE DRAWINGS

For a better understanding of the present technology, as well as other aspects and further features thereof, reference is made to the following description which is to be used in conjunction with the accompanying drawings, where.

DETAILED DESCRIPTION

The present detailed description is intended to be a description of illustrative examples of the present technology. Although described with respect to a jet propelled personal watercraft, other propulsion systems are contemplated.

Figure 1:
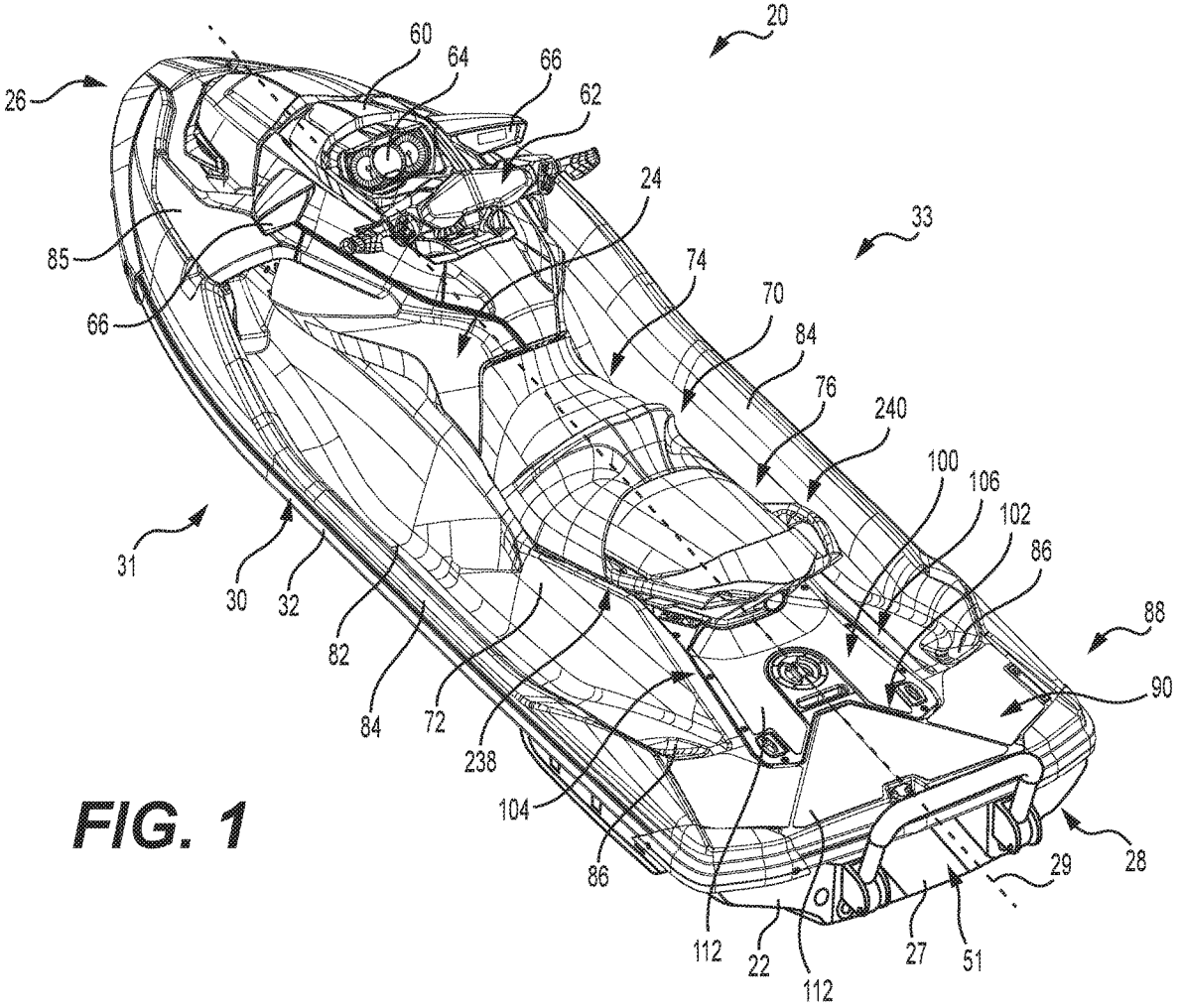
FIG. 1 is a top, left, rear side perspective view of a personal watercraft.
Figure 2:
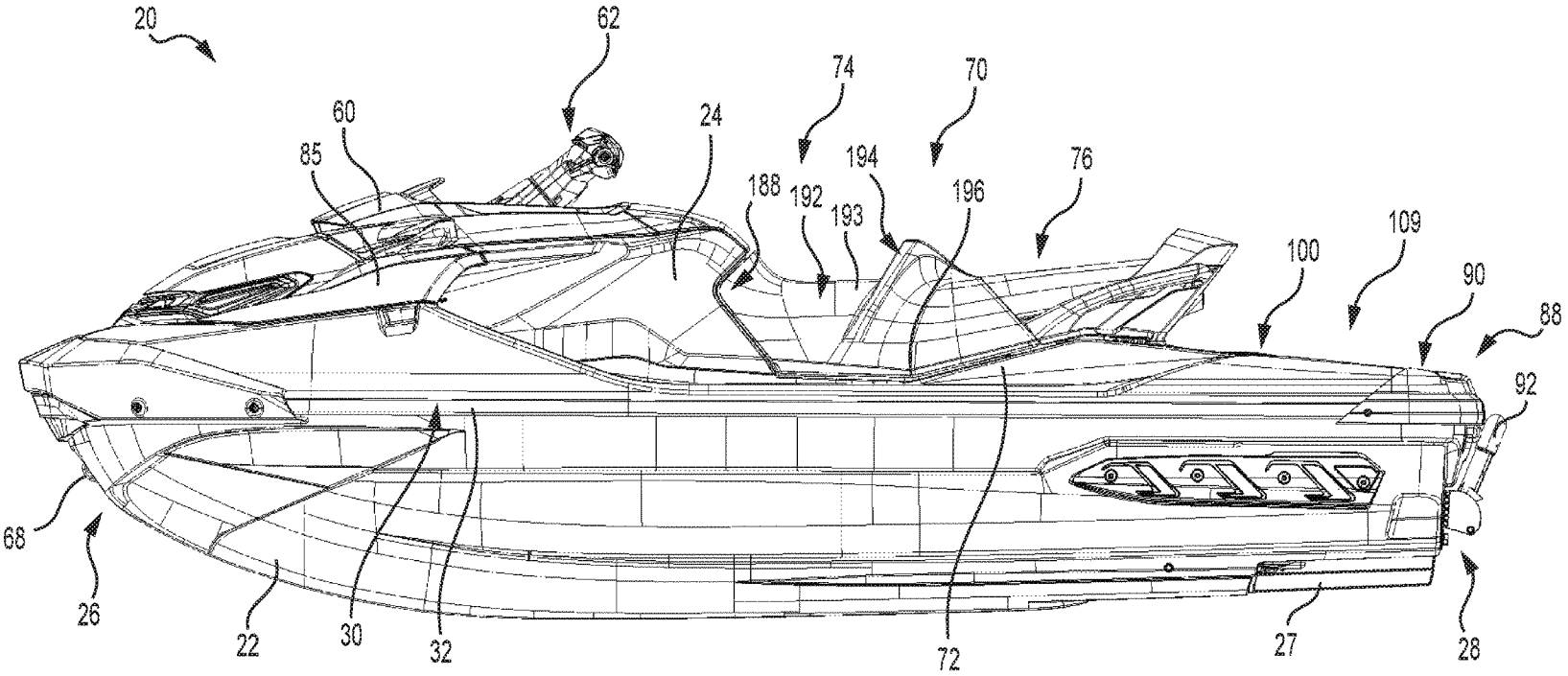
FIG. 2 is a left side elevation view of the personal watercraft of FIG. 1.
Figure 3:
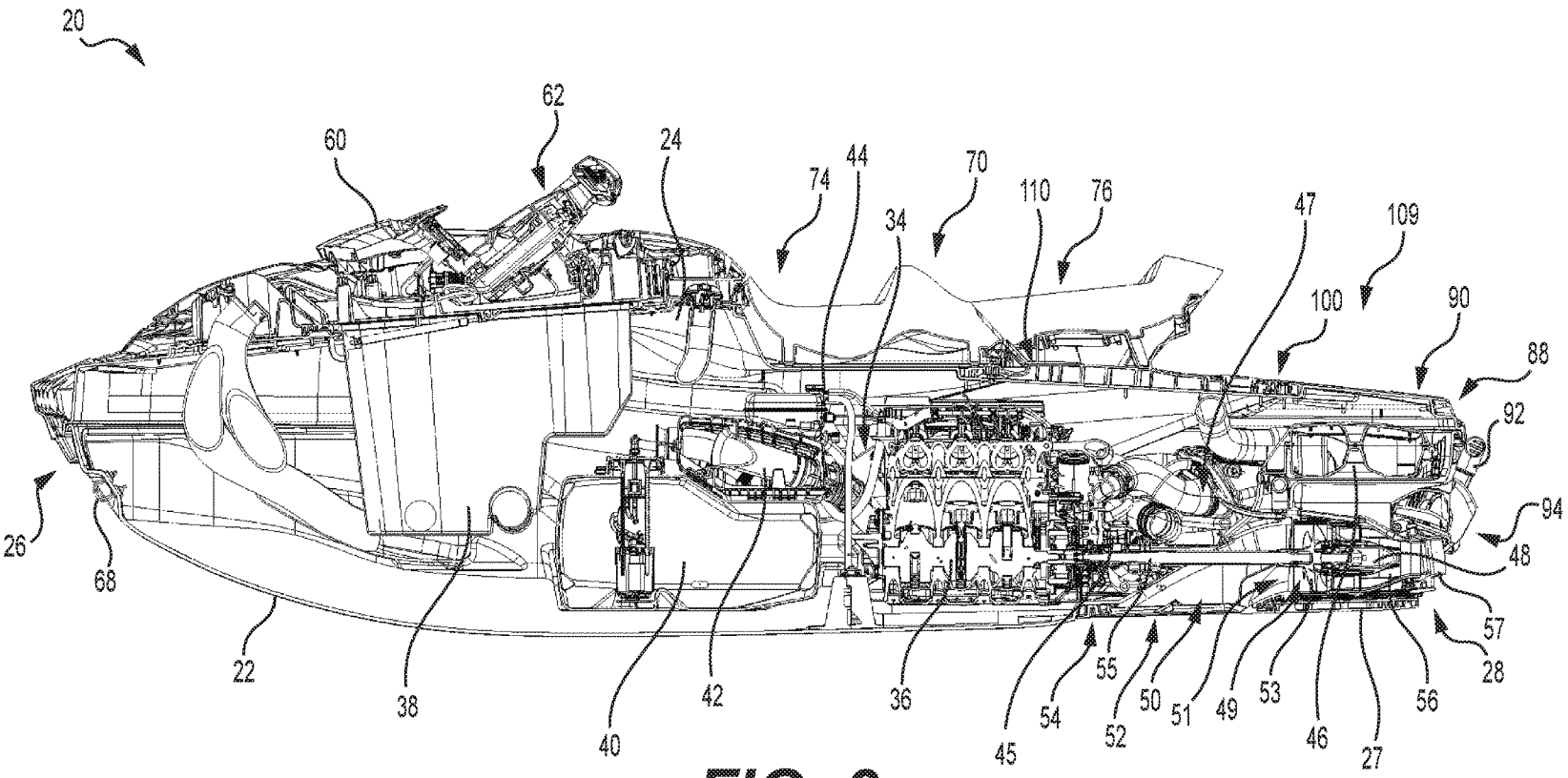
FIG. 3 is a longitudinal cross-sectional view taken from a left side of the personal watercraft of FIG. 1.

Referring to FIGS. 1 to 3, an implementation of a personal watercraft 20 is shown. The personal watercraft 20 has a hull 22 and a deck 24. The hull 22 and the deck 24 are made of fiberglass composite material. It is contemplated that other suitable materials could be used to make the hull 22 and the deck 24. The hull 22 buoyantly supports the watercraft 20 in the water. The hull 22 has a bow 26 and a stern 28. A longitudinal centerline 29 extends between the bow 26 and the stern 28 and splits the deck 24 into a left longitudinal side 31 and a right longitudinal side 33 (FIG. 1). For the purpose of the following description, the components that are qualified as "left" or "right" are positioned on the corresponding left longitudinal side 31 and right longitudinal side 33 of the deck 24, unless mentioned otherwise.

The deck 24 is designed to accommodate an operator and two passengers, collectively referred to as riders. It is contemplated that the deck 24 could be designed to accommodate just one passenger or more than two passengers. The hull 22 and the deck 24 are joined together at a seam 30 that joins the parts in a sealing relationship. The seam 30 comprises a bond line formed by an adhesive. Other known joining methods could be used to sealingly engage the parts together, including but not limited to thermal fusion, molding or fasteners such as rivets, bolts or screws. A bumper 32 generally covers the seam 30. The bumper 32 helps to prevent damage to the outer surface of the watercraft 20 when the watercraft 20 is docked, for example. The bumper 32 can extend around the bow 26 and the stern 28, as shown, or around any portion or the entire seam 30.

The space between the hull 22 and the deck 24 forms a volume commonly referred to as the motor compartment 34 (FIG. 3). The motor compartment 34 accommodates a motor 36, in the form of an internal combustion engine, as well as a storage bin 38, a fuel tank 40, an air box 42, an electrical system 44 (battery, electronic control unit, etc.), a resonator 46 and other elements required or desirable in the personal watercraft 20, such as a supercharger 45 and an intercooler 47. The motor 36 drives a water jet propulsion system 48 of the personal watercraft 20, although other types of propulsion systems are contemplated in other implementations.

The hull 22 defines part of an intake ramp 50 extending from an inlet 52 to a jet pump 49 of the jet propulsion system 48. The intake ramp 50 allows passage of water from underneath the hull 22, through the inlet 52 defined on the bottom 54 of the hull 22, and into the jet pump 49. The jet pump 49 is located in a formation in the hull 22, referred to as the tunnel 51. The tunnel 51 is defined at the front, sides, and top by the hull 22 and is open at the transom 94. As can be seen in FIGS. 1 to 3, the bottom of the tunnel 51 is closed by a ride plate 27. The ride plate 27 creates a surface on which the personal watercraft 20 rides or planes at high speeds.

The jet pump 49 includes an impeller 53 and a stator 59. The impeller 53 is coupled to the motor 36 by one or more shafts 55, such as a driveshaft and an impeller shaft. The rotation of the impeller 53 pressurizes the water, which then moves over the stator 59 that is made of a plurality of fixed stator blades (not shown). The role of the stator blades is to decrease the rotational motion of the water so that almost all the energy given to the water is used for thrust, as opposed to swirling the water. Once the water leaves the jet pump 49, it goes through a venturi 56. Since the venturi's 56 exit diameter is smaller than its entrance diameter, the water is accelerated further, thereby providing more thrust. A steering nozzle 57 is pivotally attached to the venturi 56 so as to pivot about a vertical axis (not shown). The steering nozzle 57 could also be supported at the exit of the tunnel 51 in other ways without a direct connection to the venturi 56. Moreover, the steering nozzle 57 can be replaced by a rudder or other diverting mechanism disposed at the exit of the tunnel 51 to selectively direct the thrust generated by the water jet propulsion system 48 to effect turning.

The steering nozzle 57 is operatively connected to a helm assembly 62 preferably via a push-pull cable (not shown) such that when the helm assembly 62 is turned, the steering nozzle 57 pivots. This movement redirects the pressurized water coming from the venturi 56, so as to redirect the thrust and steer the personal watercraft 20 in the desired direction.

Still referring to FIGS. 1 to 3, towards the bow 26, the deck 24 has a hood 60 including the helm assembly 62 and an instrument cluster 64. A hinge (not shown) is attached between a forward portion of the hood 60 and the front of the deck 24 to allow the hood 60 to move to an open position to provide access to the storage bin 38. A latch (not shown) located at a rearward portion of the hood 60 locks the hood 60 into a closed position. When in the closed position, the hood 60 prevents water from entering the storage bin 38. Left and right rear view mirrors 66 are positioned on corresponding left and right sides of the hood 60 to allow the operator to see behind the watercraft 20. A hook 68 is located at the bow 26 of the hull 22. The hook 68 is used to attach the watercraft 20 to a dock when the watercraft 20 is not in use or to attach to a winch when loading the watercraft 20 on a trailer, for example.

Figure 8:
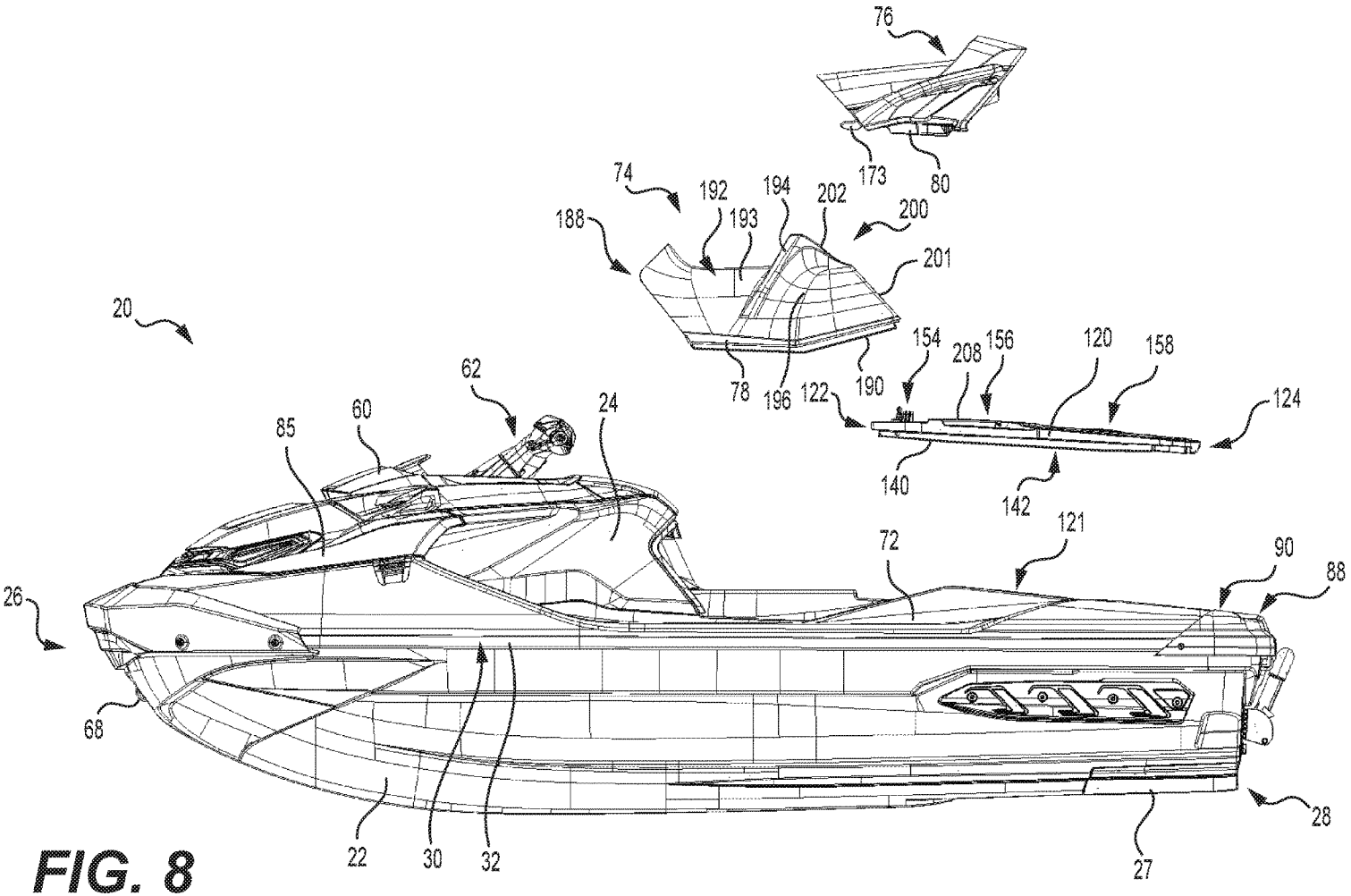
FIG. 8 is a partially exploded, left side elevation view of the personal watercraft of FIG. 1.
Figure 10:
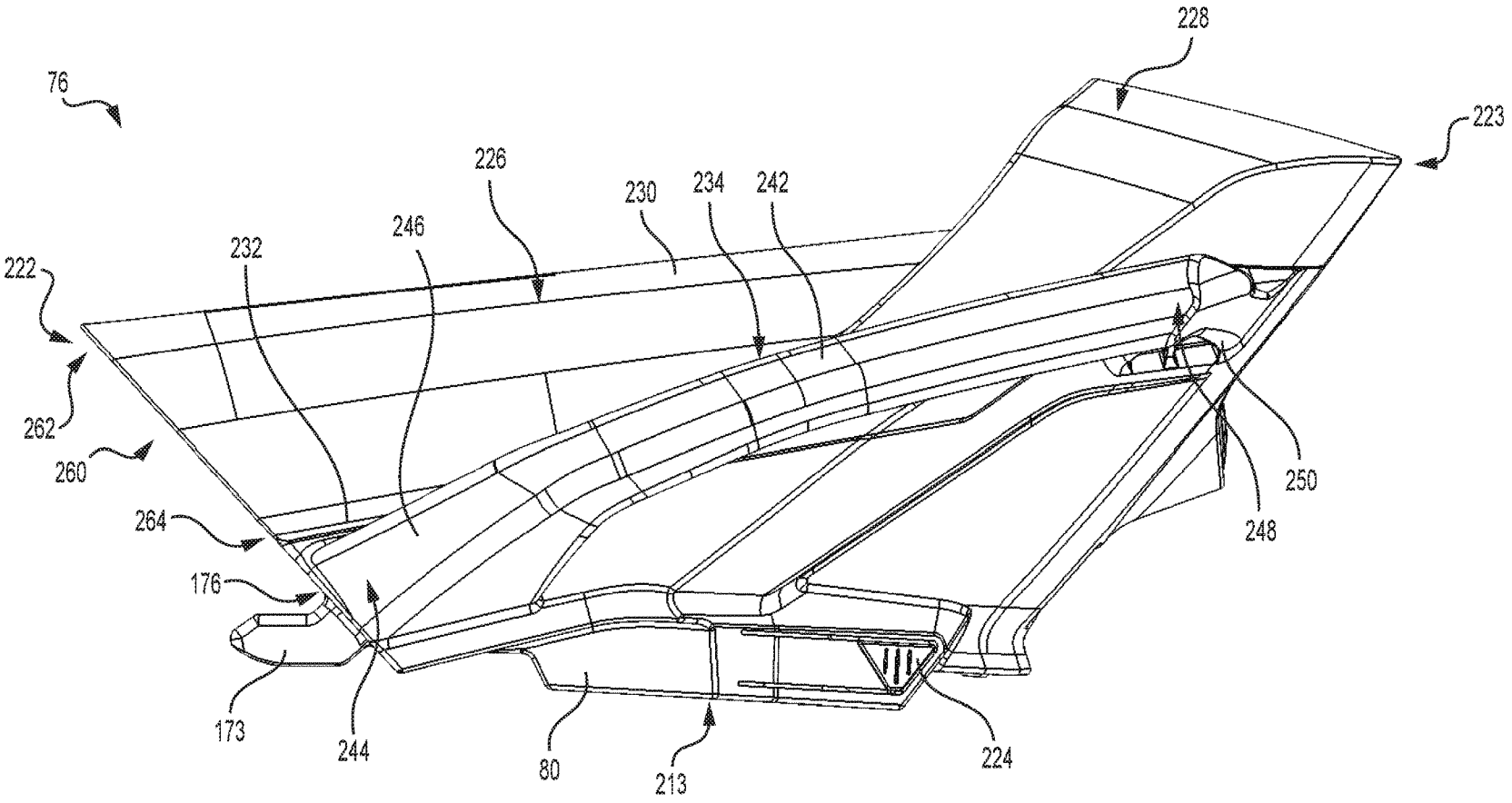
FIG. 10 is a left side elevation view of the rear seat portion of the personal watercraft of FIG. 1.

Still referring to FIGS. 1 to 3, the deck 24 has a centrally positioned straddle-type seat 70 supported on top of a pedestal 72 formed by the deck 24. Accordingly, the seat 70 and the pedestal 72 are aligned with the longitudinal centerline 29 of the deck 24. The seat 70 accommodates three riders in a straddling position. The seat 70 has a front seat portion 74 and rear seat portion 76 made as cushioned or padded units. The front seat portion 74 has a front base 78 and the rear seat portion 76 has a rear base 80 (FIG. 8). The front base 78 and the rear base 80 are interfitting and are removably connected to the deck 24. A cushion 193 is disposed on top of the front base 78 and a cushion 230 is disposed on top of the rear base 80 (FIG. 10). More detail regarding the front and rear seat portions 74, 76, the cushions 193, 230, the front and rear bases 78, 80 and their removable connection to the deck 24 will be provided below.

Figure 4:
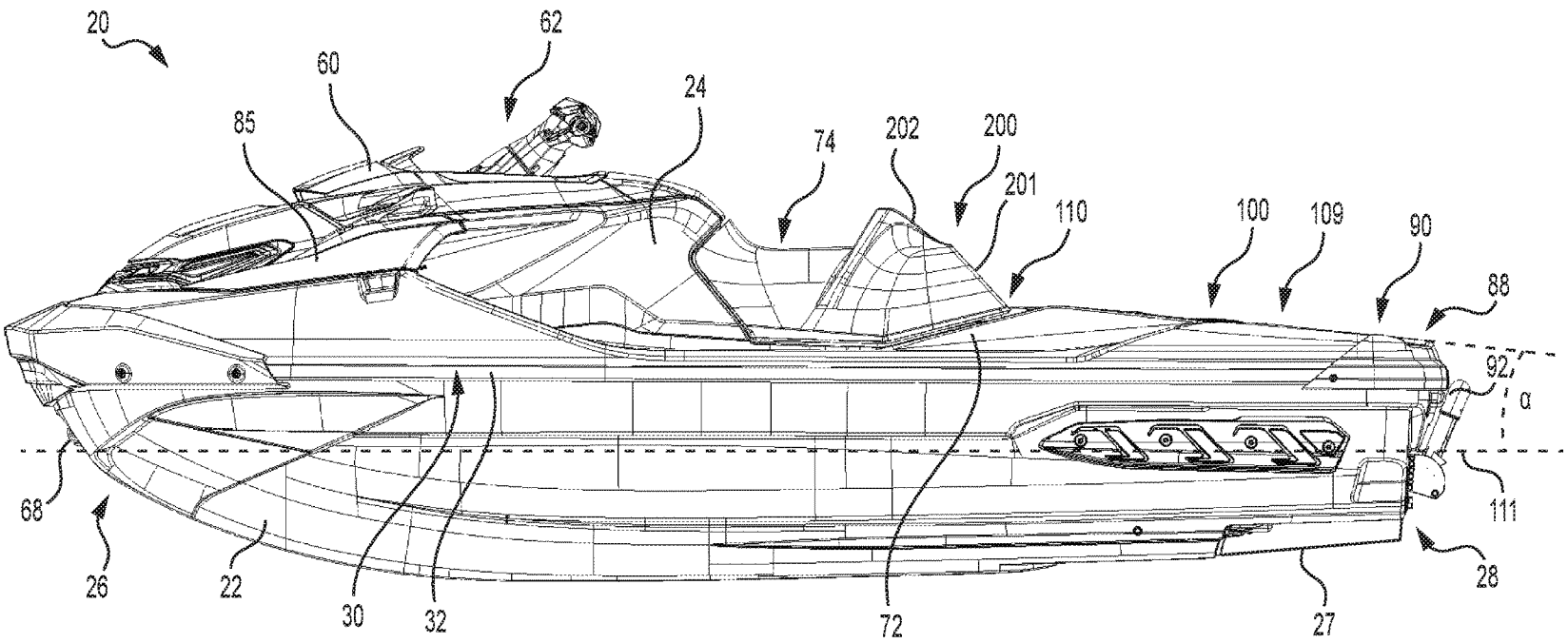
FIG. 4 is a left side elevation view of the personal watercraft of FIG. 1, with a rear seat portion removed.
Figure 5:
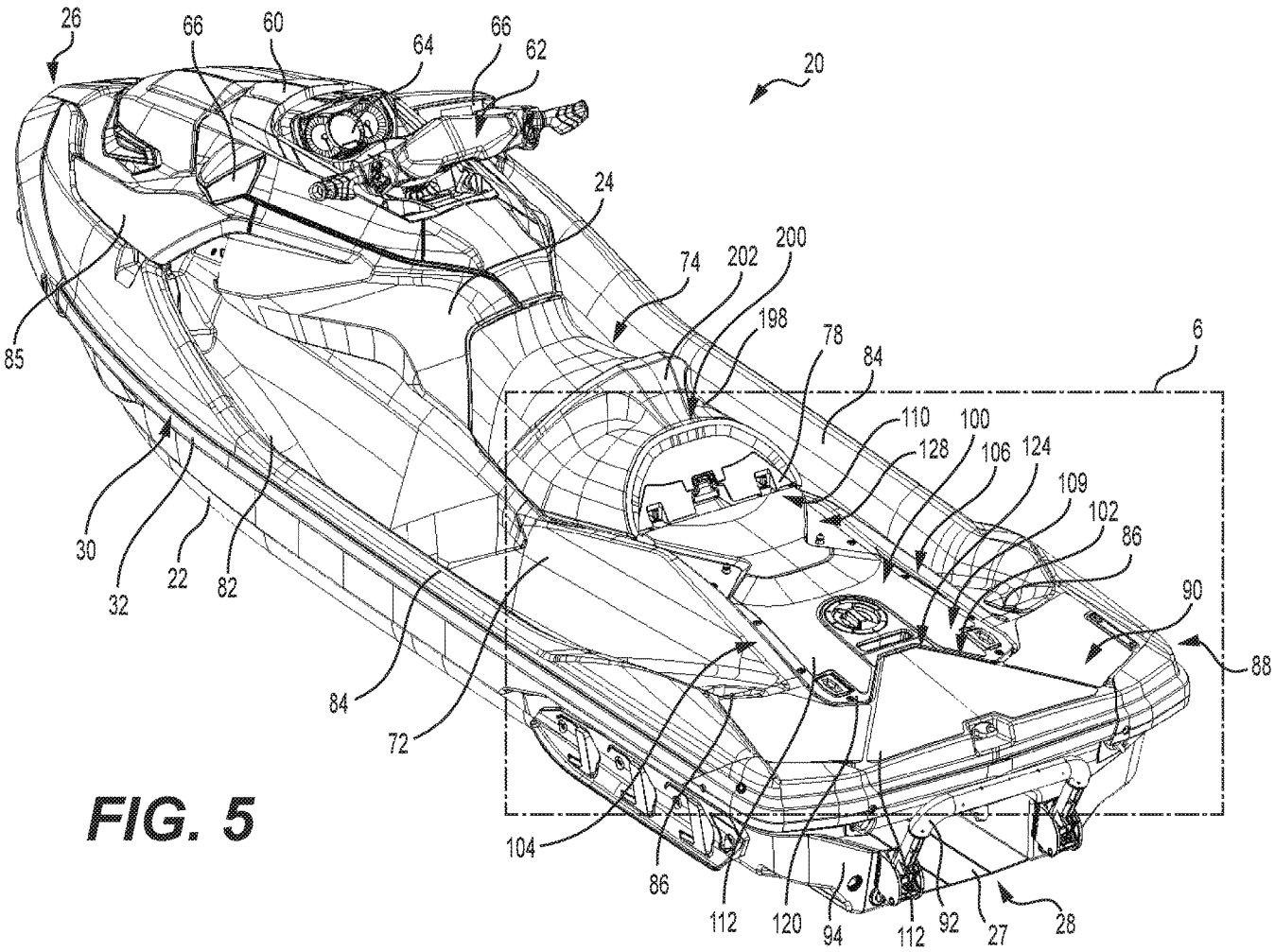
FIG. 5 is a top, left, rear side perspective view of the personal watercraft of FIG. 4.
Figure 6:
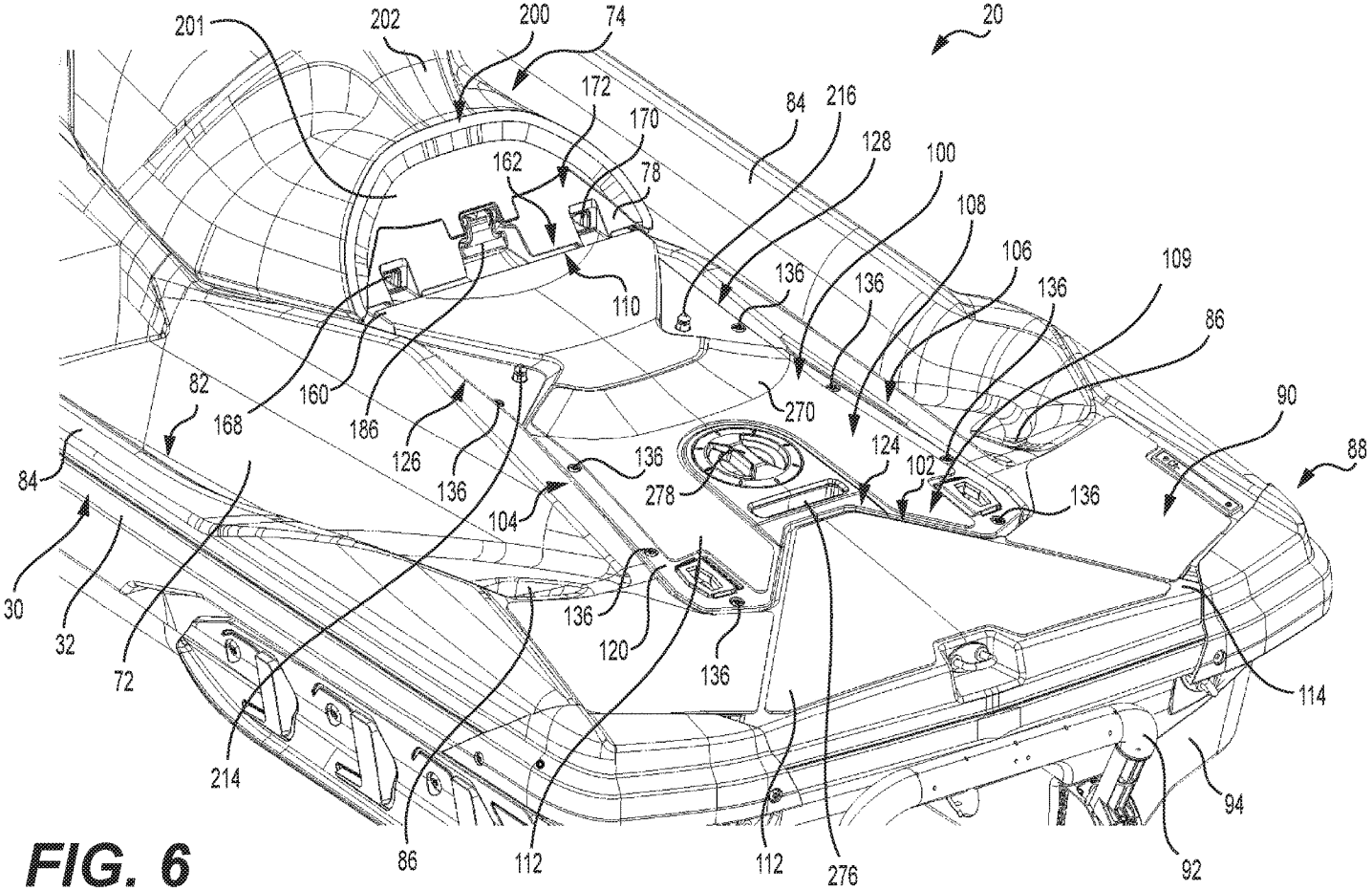
FIG. 6 is an enlarged view of the portion 6 of the personal watercraft of FIG. 1 shown in FIG. 5.

With additional reference to FIGS. 4 to 6, on the left and right sides of the pedestal 72, the deck 24 forms footwells 82 on either side of the pedestal 72 that provide support for the riders' feet. Along the footwells 82, the watercraft 20 has a pair of generally upwardly extending walls located on either side of the watercraft 20 known as gunwales or gunnels 84. The gunnels 84 help to prevent the entry of water in the footwells 82 of the watercraft 20, provide lateral support for the riders' feet, and also provide buoyancy when turning the watercraft 20, since the personal watercraft 20 can roll slightly when turning. Towards the bow 26, fairings 85 extend between the gunnels 84 and the hood 60 and further prevent the entry of water in the footwells 82. Towards the stern 28, the gunnels 84 extend inwardly to act as heel rests 86. A passenger riding the watercraft 20 and sitting on the seat 70 facing towards the rear may place his or her heels on the heel rests 86, thereby providing a more stable riding position when acting as spotter for a skier, tuber or the like. It is contemplated that the heel rests 86 could also be formed separately from the gunnels 84. Forward of a rear end 88 of the deck 24, the deck 24 includes a reboarding platform 90 allowing a rider to easily reboard the watercraft 20 from the water. The reboarding platform 90 extends longitudinally between a transom 94 of the personal watercraft 20 and the heel rests 86. The reboarding platform 90 extends laterally over a width of the deck 24, between the left side 31 and the right side 33 of the deck 24. As best seen in FIG. 5, a retractable ladder or reboarding step 92 is affixed to the transom 94 of the personal watercraft 20 to facilitate boarding of the personal watercraft 20 from the water onto the reboarding platform 90.

The personal watercraft 20 has a rear platform 100. The rear platform 100 is laterally centered on the deck 24, i.e. laterally centered along the longitudinal centerline 29 of the deck 24. The rear platform 100 extends forwards between footwells 82, from the reboarding platform 90. The rear platform 100 has a rear side 102, a left side 104 and a right side 106. Towards the rear side 102, the left and right sides 104, 106 of the rear platform 100 are adjacent to the reboarding platform 90 and to the heel rests 86. The rear side 102 of the rear platform 100 is adjacent to the reboarding platform 90. The left and right sides 104, 106 extend forward, along an edge of pedestal 72, vertically higher than the left and right footwells 82. As can be seen in FIG. 6, the rear platform 100 has a top face 108. The top face 108 of the rear platform 100 has a portion which is generally coplanar with the reboarding platform 90. The term "coplanar" is to be understood in the sense that the top face 108 of the rear platform 100 and the reboarding platform 90 form a generally planar surface 109 at the rear of the deck 24, as shown in FIGS. 2 and 4. In other words, the generally planar surface 109 extends forward of the rear end 88 of the deck 24.

As can be seen in FIGS. 4 to 6 where the rear seat portion 76 has been removed from the top face 108 of the rear platform 100, the rear platform 100 has a front end 110. At the front end 110, the rear platform 100 is delimited by the front base 78 of the front seat portion 74. As can be seen in FIG. 3, the front end 110 of the rear platform 100 extends forward past the inlet 52 of the intake ramp 50.

To summarize, the rear platform 100 extends laterally between the left and right sides 104, 106 thereof, and longitudinally between the reboarding platform 90 and the front base 78 of the front seat portion 74. Thus, the generally planar surface 109, formed by the rear platform 100 and the reboarding platform 90, extends from the rear end 88 of the deck 24 to the front base 78 of the front seat portion 74.

Referring to FIG. 4, it can also be seen that the generally planar surface 109 formed by the rear platform 100 and the reboarding platform 90 extends upwardly and forwardly from the rear end 88 of the deck 24. The generally planar surface 109 is inclined such that an angle $\alpha$ formed between the generally planar surface 109 and a waterline 111 of the personal watercraft 20 is less than 30 degrees. In some implementations, the angle $\alpha$ is less than 15 degrees. The term "waterline" refers to the line where the water comes to on the hull 22 of the personal watercraft 20, when the personal watercraft 20 is unloaded, at rest and levelled.

Referring to FIGS. 1, 5 and 6, the rear platform 100 comprises a padding material 112 along the top face 108 of the rear platform 100 and a top face 114 (FIG. 6) of the reboarding platform 90. The padding material 112 is a foam mat having a texturized surface. Other types and configurations of padding material could be used. The padding material 112 may provide more comfort and traction to a rider boarding the watercraft 20 from the water and/or to a rider lying down on the rear platform 100.

Figure 7:
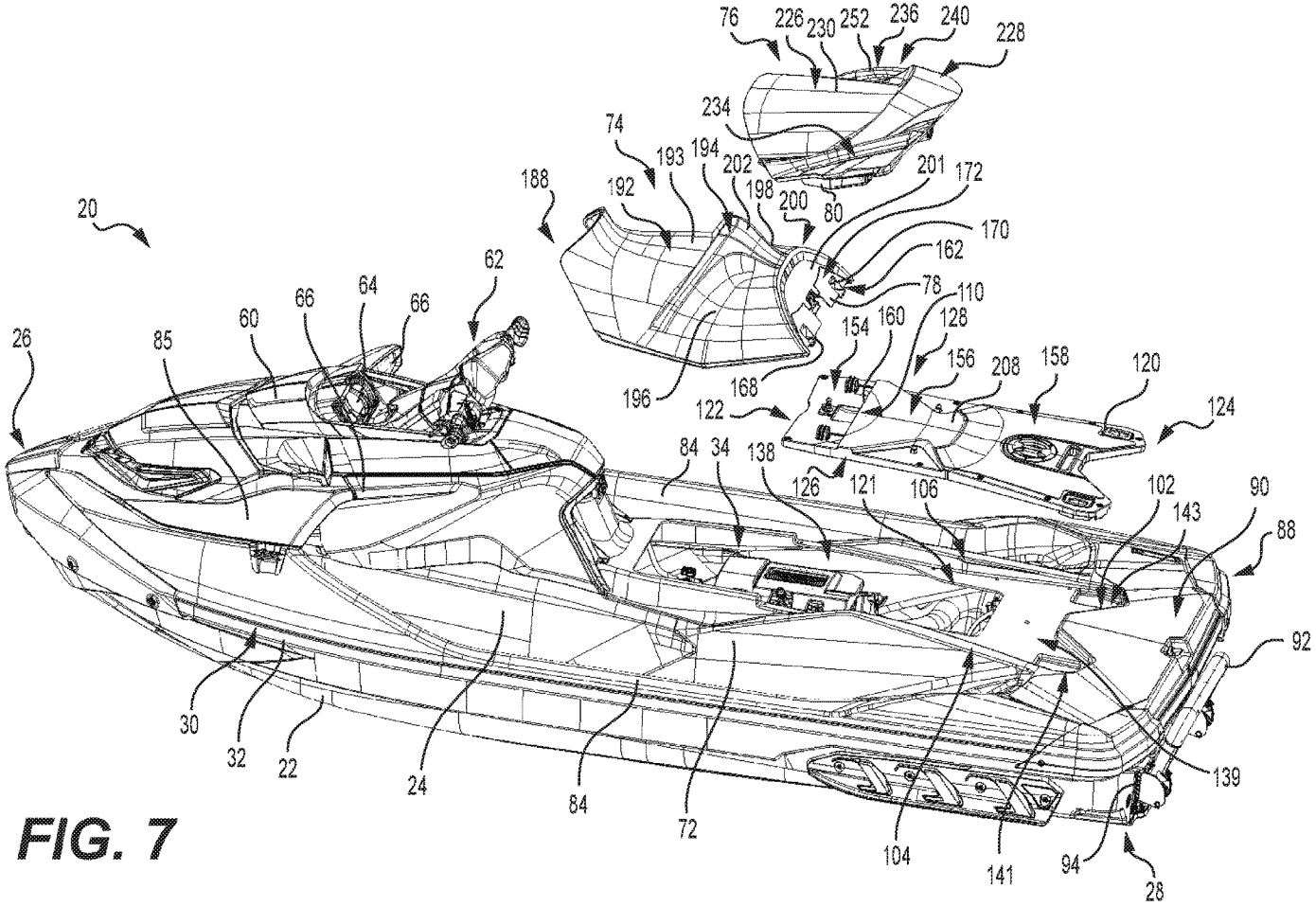
FIG. 7 is a partially exploded, top, left, rear side perspective view of the personal watercraft of FIG. 1.

Referring to FIGS. 5 to 9, the rear platform 100 includes a deck panel 120. The deck panel 120 connects to an upper central portion 121 of the deck 24 (FIGS. 7 and 8), forward of the reboarding platform 90. The upper central portion 121 of the deck 24 defines the upper portion of the pedestal 72. The deck panel 120 has a front side 122, a rear side 124, a left side 126 and a right side 128. As can be seen in FIGS. 6 and 7, the front side 122 of the deck panel 120 is forward of the front end 110 of the rear platform 100, as the front base 78 of the front seat portion 74 overlaps the front side 122 of the deck panel 120 when the front seat portion 74 is connected to the deck panel 120. The rear side 124 of the deck panel 120 is coincident with the rear side 102 of the rear platform 100. The deck panel 120 thus extends longitudinally between the reboarding platform 90 and the front seat portion 74. The left and right sides 126, 128 are adjacent to the left and right sides 104, 106 of the rear platform 100, respectively. The deck panel 120 thus extends laterally between the left and right sides 104, 106 of the rear platform 100.

Figure 9:
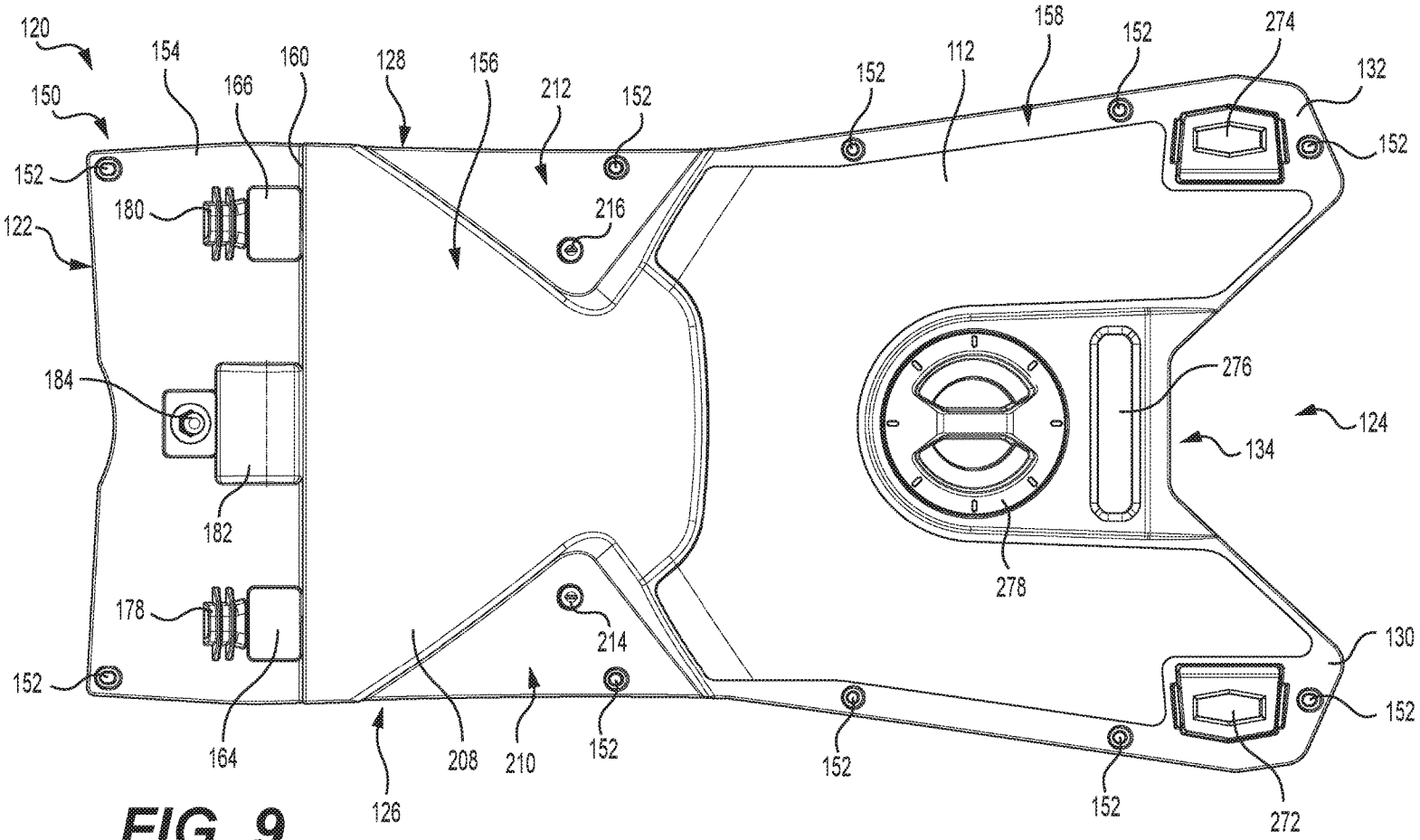
FIG. 9 is a top plan view of a deck panel of the personal watercraft of FIG. 1.

Referring to FIG. 9, the rear side 124 of the deck panel 120 has a left protrusion 130 and a right protrusion 132. An indent 134 is defined on the rear side 124 of the deck panel 120 between the left and right protrusions 130, 132. When the deck panel 120 is connected to the upper central portion 121 of the deck 24, the reboarding platform 90 extends forward in the indent 134 between the left and right protrusions 130, 132 (FIG. 6).

The deck panel 120 is connected to the upper central portion 121 of the deck 24 using ten fasteners 136 (only eight fasteners 136 are shown in FIG. 6). When the deck panel 120 is connected to the upper central portion 121 of the deck 24, the deck panel 120 partially covers an aperture 138 defined in the upper central portion 121 of the deck 24 (FIG. 7). A forward portion of the motor compartment 34 can be accessed via the portion of the aperture 138 that is not covered by the deck panel 120 when the front and rear seat portions 74, 76 are removed. To access the forward and rearward portions of the motor compartment 34, the front and rear seat portions 74, 76 and the deck panel 120 are removed, as shown in FIGS. 7 and 8. As can be seen in FIG. 7, the deck panel 120 is received in a deck recess 139 defined between the reboarding platform 90 and the aperture 138. On the left and right sides of the indent 134, the deck recess 139 defines left and right anchor recesses 141, 143. The left and right anchor recesses 141, 143 are configured to receive corresponding left and right anchor fixtures 272, 274 provided on the deck panel 120. The left and right anchor fixtures 272, 274 will be described further below.

Referring to FIG. 8, a gasket 140 is connected to a bottom face 142 of the deck panel 120 to help prevent water infiltration into the engine compartment 34 when the deck panel 120 is connected to the upper central portion 121 of the deck 24. The gasket 140 is shaped and configured to seal a spacing between the deck panel 120 and the upper central portion 121 of the deck 24 when the deck panel 120 is connected thereto. In an alternative implementation, a gasket could be connected to the upper central portion 121 of the deck instead of being connected to the bottom face 142 of the deck panel 120.

It is contemplated that the deck panel 120 could be configured otherwise. For instance, in an alternative implementation where an aperture defined in the upper central portion of the deck would be smaller than the aperture 138, the deck panel 120 could be dimensioned so as to cover that aperture and not necessarily have, for example, the left and right sides adjacent to the left and right sides 104, 106 respectively of the rear platform 100. In an alternative implementation, the deck panel could also be formed integrally with the deck 24.

Referring to FIG. 9, the deck panel 120 has a top face 150. The deck panel 120 has ten bolt holes 152 extending between the top face 150 and the bottom face 142. Five bolt holes 152 are defined on both left and right sides 126, 128 respectively of the deck panel 120. The bolt holes 152 allow the deck panel 120 to be connected to the upper central portion 121 of the deck 24 using the fasteners 136 mentioned above. Other configurations of bolt holes 152 and/or fasteners 136 could be used. The top face 150 of the deck panel 120 has a front seat area 154, a rear seat area 156 and a platform area 158. Each one of the front seat area 154, the front seat portion 74, the rear seat area 156, the rear seat portion 76 and the platform area 158 will now be described in more detail.

Referring to FIGS. 6 to 9, the front seat area 154 and the connection of the front seat portion 74 thereto will now be described. The front seat area 154 extends between the front side 122, the left side 126 and the right side 128 of the deck panel 120. A wall 160 extends between the front seat area 154 and the rear seat area 156, the wall 160 extending from the left side 126 to the right side 128. The wall 160 delimits the front seat area 154 from the rear seat area 156 as the front seat area 154 extends slightly below the rear seat area 156 (FIGS. 6 to 8). When the front seat portion 74 is connected to the deck panel 120, the front base 78 of the front seat portion 74 overlaps the deck panel 120 such that the front base 78 overlaps the front seat area 154. A rear end 162 (FIGS. 6 and 7) of the front base 78 is received on the front seat area 154 and the rear end 162 is adjacent to the wall 160.

Figure 11:
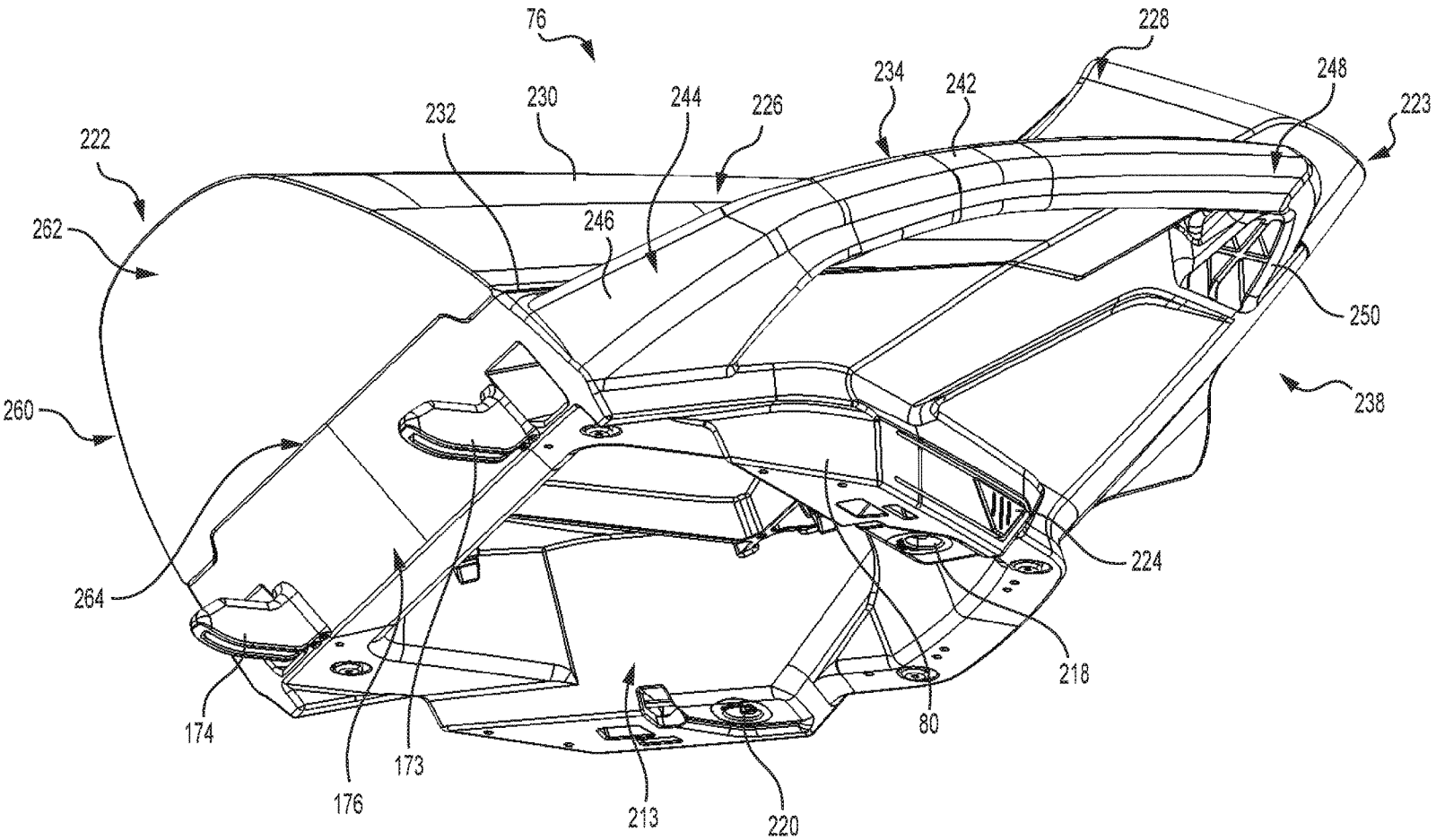
FIG. 11 is a bottom, left, front side perspective view of the rear seat portion of FIG. 10.

Still referring to FIGS. 6 to 9, the front seat area 154 of the deck panel 120 defines left and right tongue recesses 164, 166. A rear of each one of the left and right tongue recesses 164, 166 is defined by the wall 160. The left and right tongue recesses 164, 166 align with left and right tongue recesses 168, 170 defined in a rear face 172 of the front base 78. The left tongue recesses 164, 168 and the right tongue recesses 166, 170 are configured to receive corresponding left and right tongues 173, 174 extending from a front face 176 of the rear base 80 (FIG. 11). The front base 78 and the rear base 80 are thus interfitting so as to form the seat 70 of the personal watercraft 20, as mentioned above. Forward of each left and right tongue recesses 164, 166, left and right hooks 178, 180 extend upwardly from the front seat area 154. The left and right hooks 178, 180 are configured to receive the corresponding left and right tongues 173, 174. The tongue recesses 164, 166 provide clearance to pivot the tongues 173, 174 in the hooks 178, 180 when the rear seat portion 76 is connected to or removed from the deck 24. Other configurations of the tongue recesses 164, 166, 168, 170, tongues 173, 174 and hooks 178, 180 could be used so that the front base 78 and the rear base 80 are interfitting.

Referring to FIG. 9, the front seat area 154 further defines a latch recess 182 extending between the left and right tongue recesses 164, 166. The latch recess 182 is positioned along the longitudinal centerline 29 of the deck 24. A rear of the latch recess 182 is defined by the wall 160. Forward of the latch recess 182, a peg 184 extends upwardly from the front seat area 154. The peg 184 is also positioned along the longitudinal centerline 29 of the deck 24. The front base 78 has a latch (not shown) provided on the bottom face thereof. The latch is configured to connect to the peg 184. A lever 186 (FIG. 6), which is part of the latch, is accessed from the rear face 172 of the front base 78. When the lever 186 is actuated, the lever 186 releases the latch. The latch recess 182 allows for a user to grasp the lever 186 when the front base 78 is connected to the top face 150 of the deck panel 120. It is contemplated that other known seat connectors for removably connecting the front seat portion 74 to the deck 24 could be used. For example, a latch could be provided on the top face 150 of the deck panel 120 and a peg could extend downwardly from the bottom face of the front base, the peg and latch being configured to connect the front seat portion 74 to the deck 24.

An illustrative scenario describing how the front base 78 is connected to the front seat area 154 of the top face 150 of the deck panel 120 is now provided. In this scenario, the rear seat portion 76 has initially been removed from the top face 150 of the deck panel 120, as shown in FIGS. 5 and 6 for example. In a situation where the front seat portion 74 is to be removed from the deck 24 and from the top face 150 of the deck panel 120, a user first actuates the lever 186 and causes the latch to be released from the peg 184. Then, the user pulls the front seat portion 74 upwardly and tilts the front seat portion 74 forwardly in order to remove the front seat portion 74 from the deck 24. In a situation where the front seat portion 74 is to be connected to deck 24 and to the top face 150 of the deck panel 120, the front seat portion 74 is first lowered toward the deck 24 and tilted forward so that a front end 188 (FIGS. 2, 7 and 8) of the front seat portion 74 connects to the deck 24. The front end 188 of the front seat portion 74 is secured to the deck 24 through a tongue and hook connection (not shown). The tongue extends forwardly from the front end 188 and the hook is provided on the deck 24. Then, when the latch is positioned above the peg 184 and when the left and right recesses defined on the bottom face of the front base 78 are aligned with the left and right hooks 178, 180 of the front seat area 154, the front seat portion 74 is pushed downwardly until the latch connects to the peg 184.

Referring to FIGS. 2, 5, 7 and 8, the front seat portion 74 will now be described in more detail. When the front seat portion 74 is connected to the pedestal 72 of the deck 24, the front seat portion 74 covers partially the aperture 138 defined in the upper central portion 121 of the deck 24. A gasket 190 is connected to the bottom face of the front base 78 to help prevent entry of water into the engine compartment 34. The gasket 190 is sized and configured to seal a spacing between the front base 78 and the upper central portion 121 of the deck 24 when the front base 78 is connected thereto. In an alternative implementation, a gasket could be connected to the upper central portion 121 of the deck 24, the gasket surrounding the aperture 138 defined therein. The gasket could be configured to seal a spacing between the front base 78 and the upper central portion 121 of the deck 24, and a spacing between the bottom face 142 of the deck panel 120 and the upper central portion 121 of the deck 24.

Still referring to FIGS. 2, 5, 7 and 8, the front seat portion 74 has a driver seat portion 192 toward the front end 188 of the front seat portion 74. The driver seat portion 192 is configured to accommodate an operator of the personal watercraft 20 operating the vessel. The front seat portion 74 defines a back rest 194 extending upwardly and rearwardly from the driver seat portion 192. The driver seat portion 192 and the back rest 194 are made of the cushion 193, the cushion 193 being disposed on top of the front base 78 as mentioned above. The front seat portion 74 further defines left and right concave portions 196, 198 rearward of the driver seat portion 192. The left and right concave portions 196, 198 define knee rests for receiving knees of a rider of the personal watercraft 20 sitting on the rear seat portion 76 and facing forward. The left and right concave portions 196, 198 are separated by a rear surface 200 of the front seat portion 74. The rear surface 200 is also made of the cushion 193. The rear surface 200 extends upwardly of the left and right concave portions 196, 198 and along the longitudinal centerline 29 of the deck 24. The rear surface 200 extends upwardly of the rear face 172 of the front base 78. The rear surface 200 has a lower portion 201 which is generally coplanar with the rear face 172 of the front base 78. The rear surface 200 also has an upper portion 202 that is inclined such that the upper portion 202 is positioned forward relative to the lower portion 201 of the rear surface 200. As such, the rear surface 200 overlaps the front seat area 154 of the deck panel 120 (FIG. 7). The upper portion 202 of the rear surface 200 is laterally centered on the front seat portion 74. The upper portion 202 of the rear surface 200 separates the left and right concave portions 196, 198. When the rear seat portion 76 is removed, such as in FIGS. 4 to 6, the rear surface 200 is configured to accommodate a rider lying down on the rear platform 100. For example, if the rider is lying down on his back on the rear platform 100, the neck of the rider may rest on the lower portion 201 of the rear surface 200 and the head of the rider may rest on the upper portion 202 of the rear surface 200.

Referring to FIGS. 7 to 11, the rear seat area 156 of the top face 150 of the deck panel 120 and the connection of the rear seat portion 78 thereto will now be described. The rear seat area 156 extends between the left and right sides 126, 128 of the deck panel 120, the wall 160 and the platform area 158. The rear seat area 156 has a central area 208 extending above the front seat area 154 and slightly above the platform area 158 (FIGS. 7 and 8). On either sides of the central area 208, the rear seat area 156 defines left and right recessed areas 210, 212 respectively. The central area 208 may assist in aligning the rear seat portion 76 onto the rear seat area 156 during connection thereto since a bottom face 213 (FIG. 11) of the rear base 80 of the rear seat portion 76 has a corresponding hollow region. Each one of the left and right recessed areas 210, 212 includes a corresponding left and right peg 214, 216 respectively. The left and right pegs 214, 216 are configured to connect to corresponding left and right downwardly facing latches 218, 220 provided on the bottom face 213 of the rear base 80 of the rear seat portion 76 (FIG. 11). The rear base 80 also includes a left button 224 and a right button (only the left button 224 is shown) that are part of the corresponding left and right latches 218, 220. When pressed, each one of the left button 224 and the right button releases the corresponding left and right latch 218, 220 respectively from the corresponding left and right peg 214, 216.

An illustrative scenario describing how the rear base 80 is connected to the rear seat area 156 of the top face 150 of the deck panel 120 is now provided. In this scenario, the rear seat portion 76 is initially connected to the rear seat area 156, as in FIGS. 1 and 2 for example. In a situation where the rear seat portion 76 is to be removed from the rear seat area 156, a user first presses the left button 224 and the right button for releasing the corresponding latches 218, 220 from the corresponding pegs 214, 216. Then, the user pulls the rear seat portion 76 upwardly and tilts the rear seat portion 76 forwardly in order to remove the rear seat portion 76 from the rear seat area 156 and from the front base 78 such that the left and right tongues 173, 174 extending from the front face 176 of the rear base 80 (FIG. 11) are disengaged from the corresponding left and right recesses 168, 170 defined in the rear face 172 of the front base 78 and from the corresponding left and right hooks 178, 180 provided on the front seat area 154. In a situation where the rear seat portion 76 is to be connected to the rear seat area 156, the rear seat portion 76 is first lowered toward the rear seat area 156 and the rear seat portion 76 is tilted forward such that the left and right tongues 173, 174 are received in the corresponding left and right recesses 168, 170 and the left and right hooks 178, 180, and such that the left and right latches 218, 220 are aligned with the corresponding pegs 214, 216. Then, the rear seat portion 76 is pushed downwardly until the latches 218, 220 connect to the pegs 214, 216. When the rear seat portion 76 is connected to the rear seat area 156, the front seat portion 74 cannot be removed since the lever 186 is covered by the front face 176 of the rear base 80.

It is contemplated that seat connectors other than the peg and latch combination described above could be used for connecting the rear seat portion 76 to the rear seat area 156. In an alternative implementation, more than two pegs and latches could be used. In an alternative implementation, the rear base 80 has left and right downwardly extending pegs and the rear seat area 156 has corresponding upwardly facing latches.

Referring to FIGS. 10 and 11, the rear seat portion 76 will now be described in more detail. The rear seat portion 76 has a front end 222 and a rear end 223. A passenger seat portion 226 extends between the front end 222 and the rear end 223. The passenger seat portion 226 is configured to accommodate two passengers on the personal watercraft 20. The rear seat portion 76 defines a back rest 228 extending upwardly and rearwardly from the passenger seat portion 226, toward the rear end 223. The passenger seat portion 226 and the back rest 228 are made of the cushion 230, the cushion 230 being disposed on top of the rear base 80 as mentioned above. As can be seen in FIGS. 10 and 11, a majority of the left and right lateral sides 238, 240 (FIG. 1) of the rear base 80 are not covered by the cushion 230 as a lower edge 232 of the cushion 230 extends above the rear base 80. In other words, the left and right lateral sides 238, 240 of the rear base 80 remain exposed.

Referring to FIGS. 7, 10 and 11, left and right grab handles 234, 236 respectively are connected to the corresponding left and right lateral sides 238, 240 of the rear base 80. The left and right grab handles 234, 236 are configured to provide a handle onto which the one or more passengers of the personal watercraft 20 may hold. The left grab handle 234 extends from the left lateral side 238 of the rear base 80, and the right grab handle 236 extends from the right lateral side 240 of the rear base 80. As such, when the rear seat portion 76 is removed from the rear seat area 156, the left and right grab handles 234, 236 are removed from the deck 24 as well. The left and right grab handles 234, 236 are integral with the rear base 80. It is contemplated that the left and right grab handles 234, 236 could be connected to the rear base 80 otherwise, with fasteners for example.

Still referring to FIGS. 7, 10 and 11, the left grab handle 234 will now be described in more detail. The left grab handle 234 has a handle portion 242. A front 244 of the handle portion 242 is connected to the rear base 80 by a front connecting arm 246. A rear 248 of the handle portion 242 is connected to the rear base 80 by a rear connecting arm 250. As can be seen in FIG. 10, the rear connecting arm 250 connects to the rear base 80 upwardly and rearwardly relative to the front connecting arm 246. The front connecting arm 246 connects to the rear base 80 rearward of the front face 176 thereof and the rear connecting arm 250 connects to the rear base 80 forward of the rear end 223 of the rear seat portion 76. The front connecting arm 246 of the left grab handle 234 is disposed forward of the left latch 218 and the rear connecting arm 250 of the left grab handle 234 is disposed rearward of the left latch 218. Both the front and rear connecting arms 246, 250 respectively are positioned below the lower edge 232 of the cushion 230.

The right grab handle 236 is connected to the right lateral side 240 of the rear base 80 in a fashion similar to the left grab handle 234. Accordingly, the right grab handle 236 has a handle portion 252 (FIG. 7). A front (not shown) of the handle portion 252 is connected to the rear base 80 by a front connecting arm (not shown). A rear (not shown) of the handle portion 252 is connected to the rear base 80 by a rear connecting arm (not shown). As for the left grab handle 234, the front connecting arm of the right grab handle 236 is disposed forward of the right latch 220, and the rear connecting arm of the right grab handle 236 is disposed rearward of the right latch 220.

Still referring to FIGS. 7, 10 and 11, the rear seat portion 76 also has a front surface 260 extending upwardly between the front face 176 of the rear base 80 and the front end 222 of the rear seat portion 76. The front surface 260 is inclined such that an upper portion 262 of the front surface 260 is positioned forward relative to a lower portion 264 of the front surface 260. As such, when the front seat portion 74 is connected to the front seat area 154 and when the rear seat portion 76 is connected to the rear seat area 156, the front surface 260 of the rear seat portion 76 is adjacent to the rear surface 200 of the front seat portion 74.

It is contemplated that when the rear seat portion 76 is removed from the rear seat area 156 as described above, the rear seat portion 76 can be placed inside the storage bin 38. Once a rider removes the rear seat portion 76 from the rear seat area 156 as described above, the rider then unlocks the latch of the hood 60, pivots the hood 60 into the open position, inserts the rear seat portion 76 into the storage bin 38, pivots the hood 60 in the closed position and finally locks the latch of the hood 60. The configuration of the seat 70 of the personal watercraft 20 can thus be adjusted by a rider without using tools and while being on the water. Alternatively, the rear seat portion 76 could be removed and left at the dock.

Referring to FIGS. 6 and 9, the platform area 158 will now be described in more detail. The platform area 158 extends between the rear seat area 156 and the rear, left and right and rear sides 124, 126, 128 respectively of the deck panel 120. As can be seen in FIG. 6, the platform area 158 has an inclined portion 270 adjacent to the rear seat area 156. At the front extremity of the inclined portion 270, the platform area 158 is levelled with the central area 208 of the rear seat area 156. The inclined portion 270 smoothens down the difference between the level of the rear seat area 156 and the rear of the platform area 158. Padding material 112, described above with respect to the reboarding platform 90, is also connected to the top face 150 of the deck panel 120 over a portion of the platform area 158. On the left and right protrusions 130, 132 of the deck panel 120, the platform area 158 has the left and right anchor fixtures 272, 274. The left and right anchor fixtures 272, 274 are configured to fix various items to the deck panel 120, including and not limited to a cargo box, a cooler or a fuel tank.

Forward of the indent 134, the platform area 158 also defines a handhold 276. A rider may grasp the handhold 276 to facilitate boarding of the watercraft 20 from the water onto the reboarding platform 90. Forward of the handhold 276, the deck panel 120 includes a cap 278. The cap 278 can be removed and allow for a tow mast (not shown) to be placed in a hole (not shown) defined in the deck 24. The tow mast is a separate part that can be placed inside the storage bin 38, and placed in the hole of the deck 24 when needed. For instance, the tow mast can be used when towing a skier, a tuber or the like. It is also contemplated that other accessories, such as a fishing seat having a post extending below the seat, could be placed in the hole of the deck 24 when needed.

In an implementation, the rear platform 100 is configured to provide flexibility, thanks to the configurable seat 70, and convenience, thanks to the generally planar surface 109 of the rear platform 100 and the reboarding platform 90, to an operator of the personal watercraft 20. Different examples of the use of the seat 70 and of the rear platform 100 will now be briefly described.

When the operator desires to carry one or more passengers, the rear seat portion 76 is connected to the rear seat area 156 and the one or more passengers can sit on the rear seat portion 76. At the same time, the rear platform 100 provides room for fixing items, such as a cooler, thereto using at least one of the anchor fixtures 272, 274 and the hole of the deck 24.

When the operator desires to carry one or more large or bulky items, such as a cargo box, a cooler or a fuel tank, the operator may remove the rear seat portion 76 from the rear seat area 156, store the rear seat portion 76 inside the storage bin 38, and fix the one or more items to the rear platform 100 using at least one of the anchor fixtures 272, 274 and the hole of the deck 24.

When the personal watercraft 20 is stopped, a rider may remove the rear seat portion 76 from the rear seat area 156, store the rear seat portion 76 inside the storage bin 38 or one of the footwells 82 and use the rear platform 100 as a sunbathing platform. The rider may thus lie down on the rear platform 100 and rest his/her head and neck on the rear surface 200 of the front seat portion 74.

In an implementation, the rear platform 100 is configured for conducting search and rescue operations. In such an implementation, the platform area 158 could include a floating mattress connected to the top face 150 of the deck panel 120. Rescue equipment, such as a first aid kit and an oxygen bottle, could be anchored to the left and right anchor fixtures 272, 274.

During search and rescue operations, the personal watercraft 20 may provide flexibility, thanks to the configurable seat 70, and convenience, thanks to the rear platform 100. For instance, a rescuer may drive the personal watercraft 20 to a person to rescue. The rescuer may help the person to board the watercraft 20 by pulling the person onto the generally planar surface 109 formed by the rear platform 100 and the reboarding platform 90. If the person is capable, the person may sit on the passenger seat portion 226 while the rescuer drives the personal watercraft 20. If the person is incapable to sit on the passenger seat portion 226, the rescuer may remove the rear seat portion 76 from the rear seat area 156 and store the rear seat portion 76 inside the storage bin 38 or in one of the footwells 82, allowing the person to lie down on the rear platform 100 and rest his/her head and neck on the rear surface 200 while the rescuer drives the personal watercraft 20.

Modifications and improvements to the above-described implementation of the present technology may become apparent to those skilled in the art. The foregoing description is intended to be exemplary rather than limiting. The scope of the present technology is therefore intended to be limited solely by the scope of the appended claims.

What is claimed is:

1. A personal watercraft comprising:

a hull having a bow and a stern;

a deck disposed on the hull, the deck comprising:

a rear platform having a top face, the top face defining at least a portion of a generally planar surface, the generally planar surface extending forward from a rear end of the deck; and a reboarding platform extending forward from the rear end of the deck, the reboarding platform defining a portion of the generally planar surface, the rear platform extending forward of the reboarding platform; and a seat supported on the deck, the seat comprising:

a front seat portion; and a rear seat portion, the rear seat portion being rearward of the front seat portion, the rear seat portion being removably connected to the deck;

the rear platform extending between the rear end of the deck and the front seat portion, the generally planar surface extending to at least the front seat portion, and the rear seat portion being disposed on the top face of the rear platform when connected to the deck.

2. The personal watercraft according to claim 1, wherein:

the rear platform comprises a deck panel, the deck panel defining a portion of the generally planar surface; and the deck panel extends between the reboarding platform and the front seat portion.

3. The personal watercraft according to claim 2, wherein:

the deck panel comprises a top face; and the rear seat portion has a rear base, the rear base being removably connected to the top face of the deck panel.

4. The personal watercraft according to claim 3, wherein:

one of the top face of the deck panel and the rear base has at least one peg;

another one of the top face of the deck panel and the rear base has at least one latch; and the at least one latch is configured to connect to the at least one peg.

5. The personal watercraft according to claim 4, wherein the top face of the deck panel defines at least one recessed area, each recessed area comprising one of the at least one peg and the at least one latch.

6. The personal watercraft according to claim 5, wherein:

the deck panel comprises a bottom face;

the personal watercraft further comprises a gasket connected to the bottom face of the deck panel;

the deck defines an aperture; and the deck panel covers at least partially the aperture when the deck panel is connected to the deck.

7. The personal watercraft according to claim 2, wherein:

the front seat portion comprises a rear surface; and the rear surface is inclined such that an upper portion of the rear surface is positioned forward relative to a lower portion of the rear surface.

8. The personal watercraft according to claim 7, wherein the rear surface overlaps the deck panel.

9. The personal watercraft according to claim 7, wherein:

the rear seat portion comprises a front surface; and the front surface is inclined such that an upper portion of the front surface is positioned forward relative to a lower portion of the front surface.

10. The personal watercraft according to claim 9, wherein the front surface of the rear seat portion is adjacent the rear surface of the front seat portion when the rear seat portion is connected to the deck.

11. The personal watercraft according to claim 1, wherein the front seat portion is removably connected to the deck.

12. The personal watercraft according to claim 11, wherein:

the front seat portion comprises a front base having a bottom face;

the personal watercraft further comprises a gasket connected to the bottom face of the front base;

the deck defines an aperture; and the front base covers at least partially the aperture when the front seat portion is connected to the deck.

13. The personal watercraft according to claim 1, wherein:

the rear seat portion has a rear base; and the personal watercraft further comprises at least one grab handle connected to the rear base.

14. The personal watercraft according to claim 13, wherein the rear base and the at least one grab handle are removable from the deck together.

15. The personal watercraft according to claim 13, wherein:

the at least one grab handle comprises a left grab handle and a right grab handle;

the left grab handle extends from a left side of the rear base; and the right grab handle extends from a right side of the rear base.

16. The personal watercraft according to claim 1, further comprising:

a propulsion system connected to at least one of the hull and the deck, the propulsion system comprising:

a motor, and a jet pump operatively connected to the motor; and an intake ramp extending from an inlet to the jet pump, the inlet being defined at least in part by the hull on a bottom of the hull, the rear platform extending forward past the inlet of the intake ramp.

17. The personal watercraft according to claim 1, wherein the generally planar surface extends upward and forward from the rear end of the deck.

18. The personal watercraft according to claim 17, wherein the generally planar surface extends at an angle of less than 30 degrees from a waterline of the personal watercraft.

19. The personal watercraft according to claim 18, wherein the angle is less than 15 degrees.

* * * * *